US011766603B2

(12) United States Patent
Xu

(10) Patent No.: US 11,766,603 B2
(45) Date of Patent: Sep. 26, 2023

(54) FOLDABLE CHESSBOARD BOX

(71) Applicant: Maili Life Technology (Shenzhen) Co., Ltd., Shenzhen (CN)

(72) Inventor: Bin Xu, Shenzhen (CN)

(73) Assignee: MAILI LIFE TECHNOLOGY (SHENZHEN) CO., LTD., Shenzhen (CN)

( * ) Notice: Subject to any disclaimer, the term of this patent is extended or adjusted under 35 U.S.C. 154(b) by 422 days.

(21) Appl. No.: 17/153,864

(22) Filed: Jan. 20, 2021

(65) Prior Publication Data

US 2022/0193533 A1 Jun. 23, 2022

(30) Foreign Application Priority Data

Dec. 18, 2020 (CN) ..... 202011506657.7

(51) Int. Cl.
*A63F 3/00* (2006.01)
*A63F 3/02* (2006.01)

(52) U.S. Cl.
CPC ..... *A63F 3/0023* (2013.01); *A63F 3/00261* (2013.01); *A63F 3/02* (2013.01); *A63F 2003/00233* (2013.01); *A63F 2003/00287* (2013.01)

(58) Field of Classification Search
CPC ..... A63F 3/0023; A63F 3/00261; A63F 3/02; A63F 2003/00233; A63F 2003/00287; A63F 3/00895; A63F 2003/00962
See application file for complete search history.

(56) References Cited

U.S. PATENT DOCUMENTS 174,958 A * 3/1876 Homrighausen ..... A63F 3/0023 273/285
4,811,954 A * 3/1989 Hemmann ..... A63F 3/0023 273/284
5,145,185 A * 9/1992 Yu ..... A63F 3/0023 273/287
5,190,127 A * 3/1993 Cummings ..... B42F 13/40 190/102
5,280,913 A * 1/1994 Sirk ..... A63F 3/0023 273/287
5,952,637 A * 9/1999 Strunk ..... A63F 3/0023 235/90
2007/0102881 A1* 5/2007 Holden ..... A63F 3/00895 273/260
2010/0032903 A1* 2/2010 Wang ..... A63F 3/02 273/260

* cited by examiner

*Primary Examiner* — Michael D Dennis

(57) ABSTRACT

A foldable chessboard box is provided in the present application, including a first body and a second body which are hinged through a connecting portion so that the first body can be opened or buckled relative to the second body. The first body is provided with a first surface and a second surface, and the second body is provided with a third surface and a fourth surface. Both the first surface and the third surface are provided with a receiving slot for accommodating chess pieces. Both the first surface and the third surface are provided with a chessboard pattern. The second surface is provided with at least one first installation slot, and the fourth surface is provided with at least one second installation slot, wherein each first installation slot is fixedly provided with a first supporting portion, and each second installation slot is fixedly provided with a second supporting portion.

10 Claims, 5 Drawing Sheets

FOLDABLE CHESSBOARD BOX

CROSS-REFERENCE TO RELATED APPLICATIONS

This application claims priority to Chinese Patent Application No. 202011506657.7, filed Dec. 18, 2020, the contents of which are incorporated herein by reference.

BACKGROUND

1. Technical Field

The present invention relates to a field of chess game appliances, especially to a foldable chessboard box.

2. Description of Related Art

Chess games have long been popularized in human's daily life, such as international chess, Chinese chess, go, checkers, gobang, tic-tac-toe, etc. All kinds of chess games are simple in structure, easy to be understood in rules, and unlimited in playing places. While being interesting, chess games can exercise the intelligence of players and enlighten their minds, thus are deeply loved by people. Various types of chess generally include chess pieces and chessboards. At present, chess pieces and chessboards are stored separately, which leads to the problem of inconvenient storage and carrying.

Therefore, a foldable chessboard assembly has appeared on the market, which can not only serve as a chessboard, but also store chess pieces. However, when this foldable chessboard assembly is used as a chessboard, there is a problem of unstable placement, resulting in the failure of forming a flat surface by the chessboard, which affects the user's chess playing experience.

DETAILED DESCRIPTION

The present application will be further described below with reference to the accompanying drawings for further clearly and fully discussing the technical solutions of the present invention.

Figure 1:
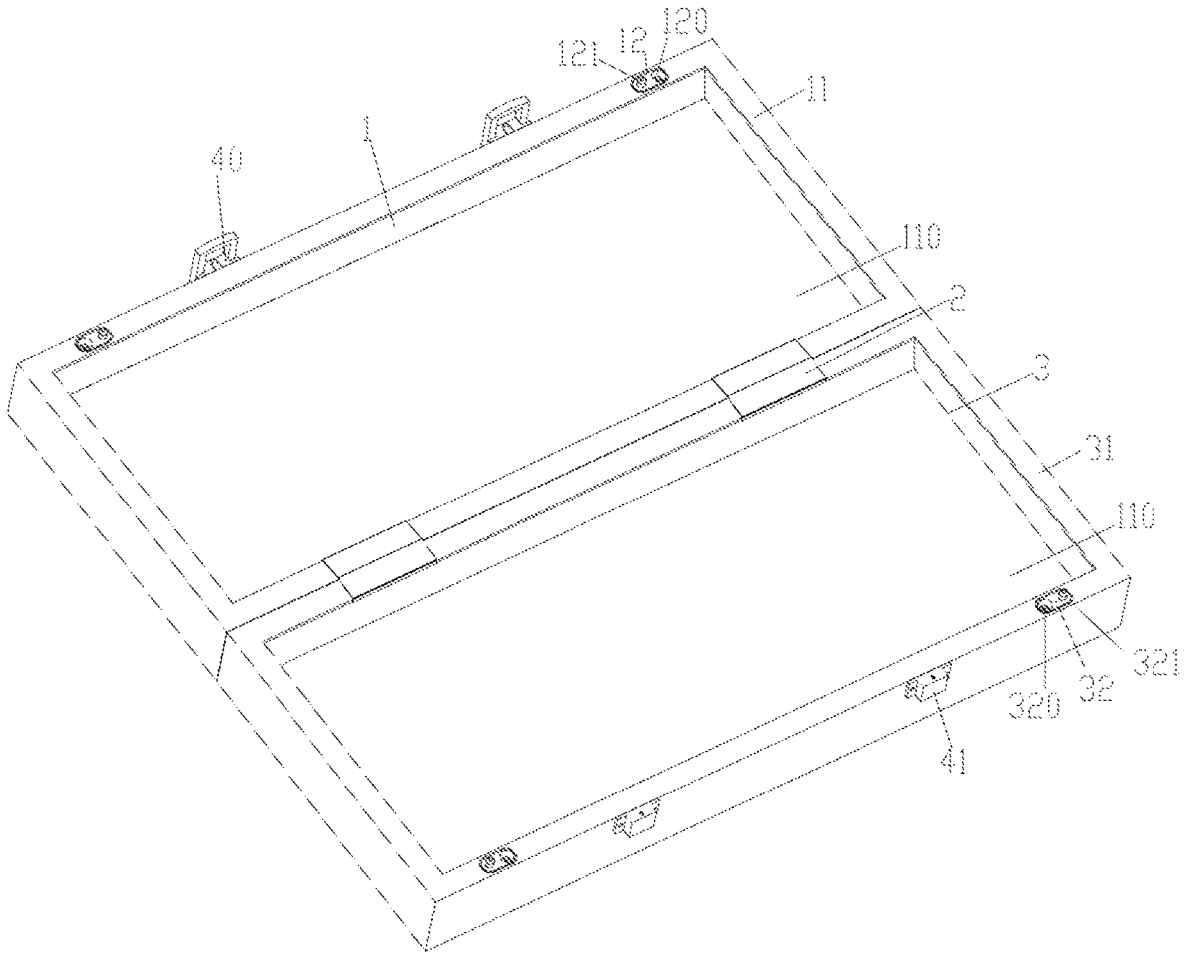
FIG. 1 shows a schematic view of the foldable chessboard box according to the present application in an unfolded state.
Figure 2:
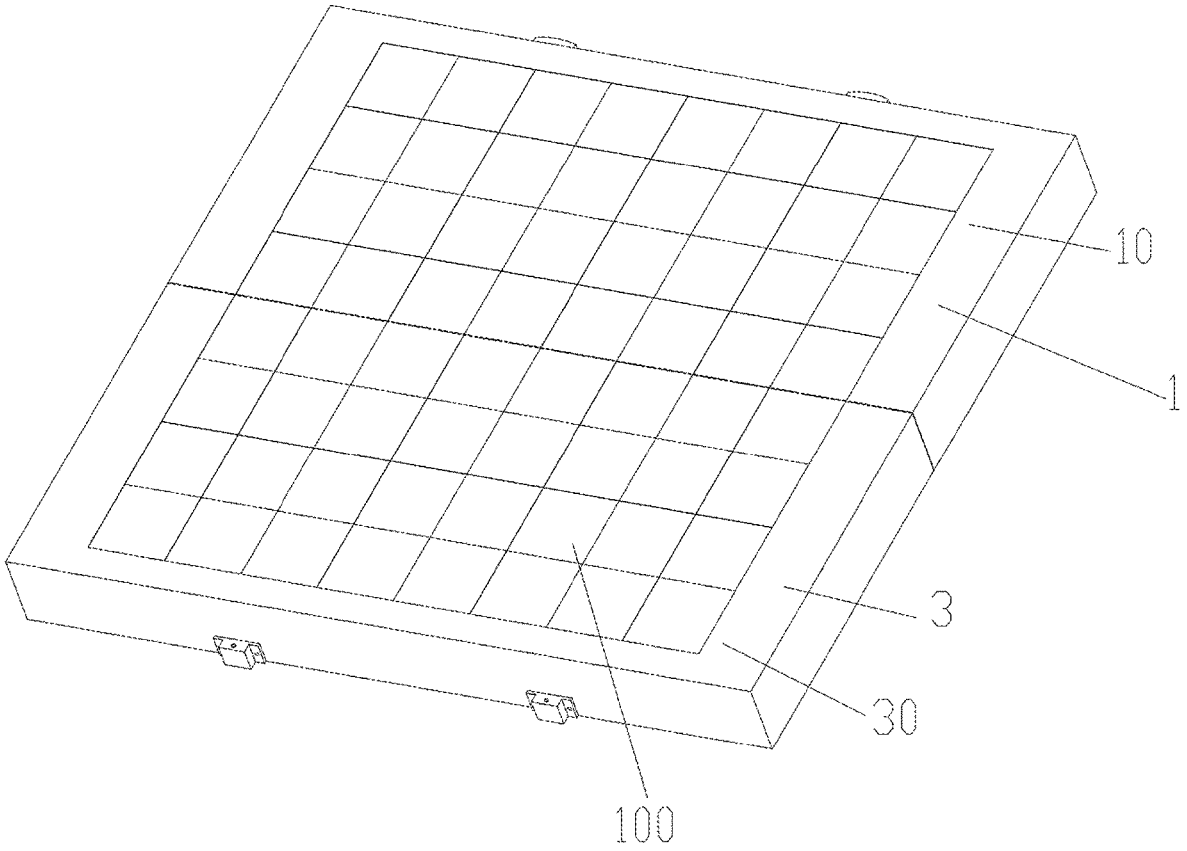
FIG. 2 shows a schematic view of the foldable chessboard box according to the present application in an unfolded state.
Figure 3:
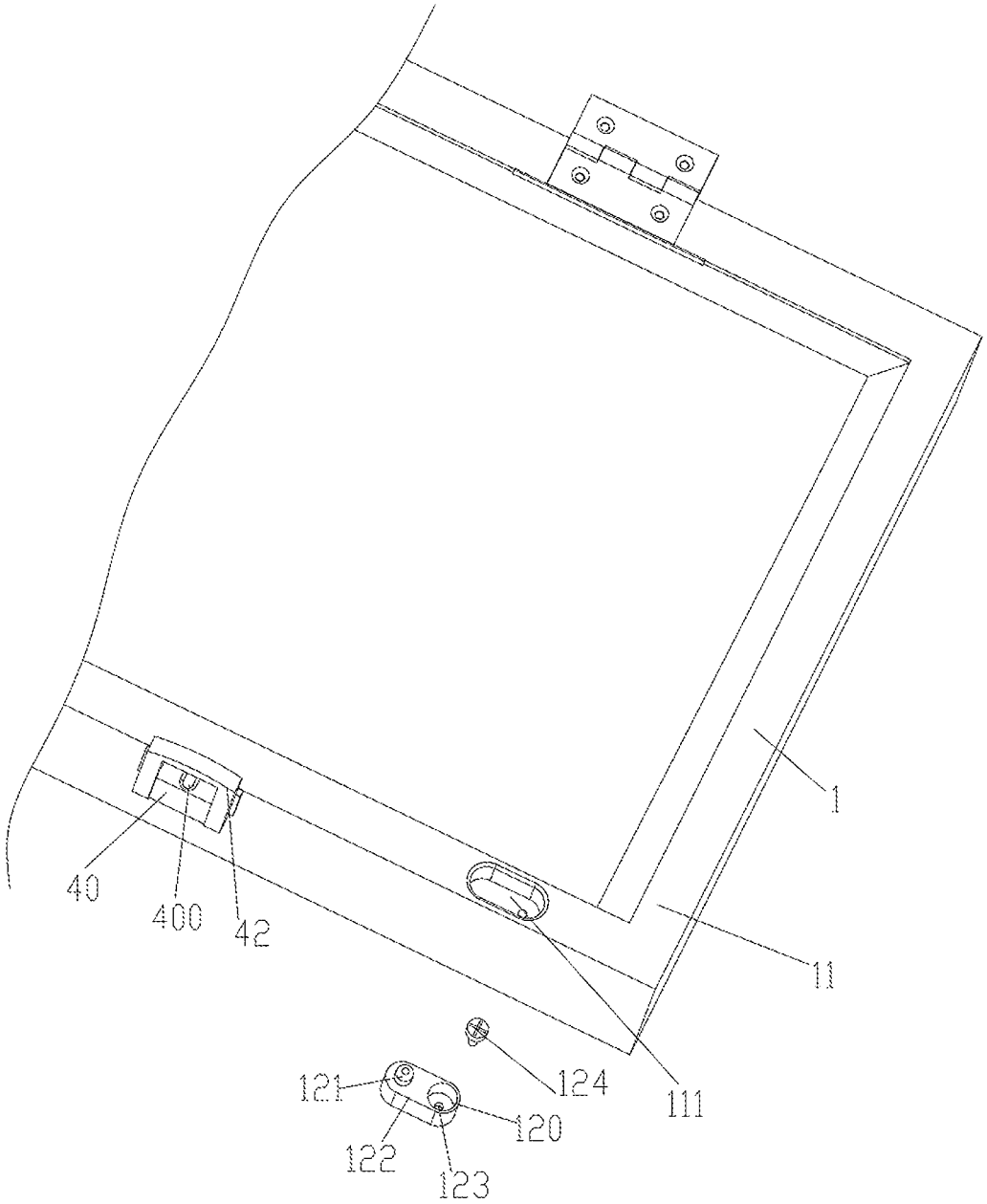
FIG. 3 shows an exploded schematic view of a partial structure of the foldable chessboard box according to the present application.
Figure 4:
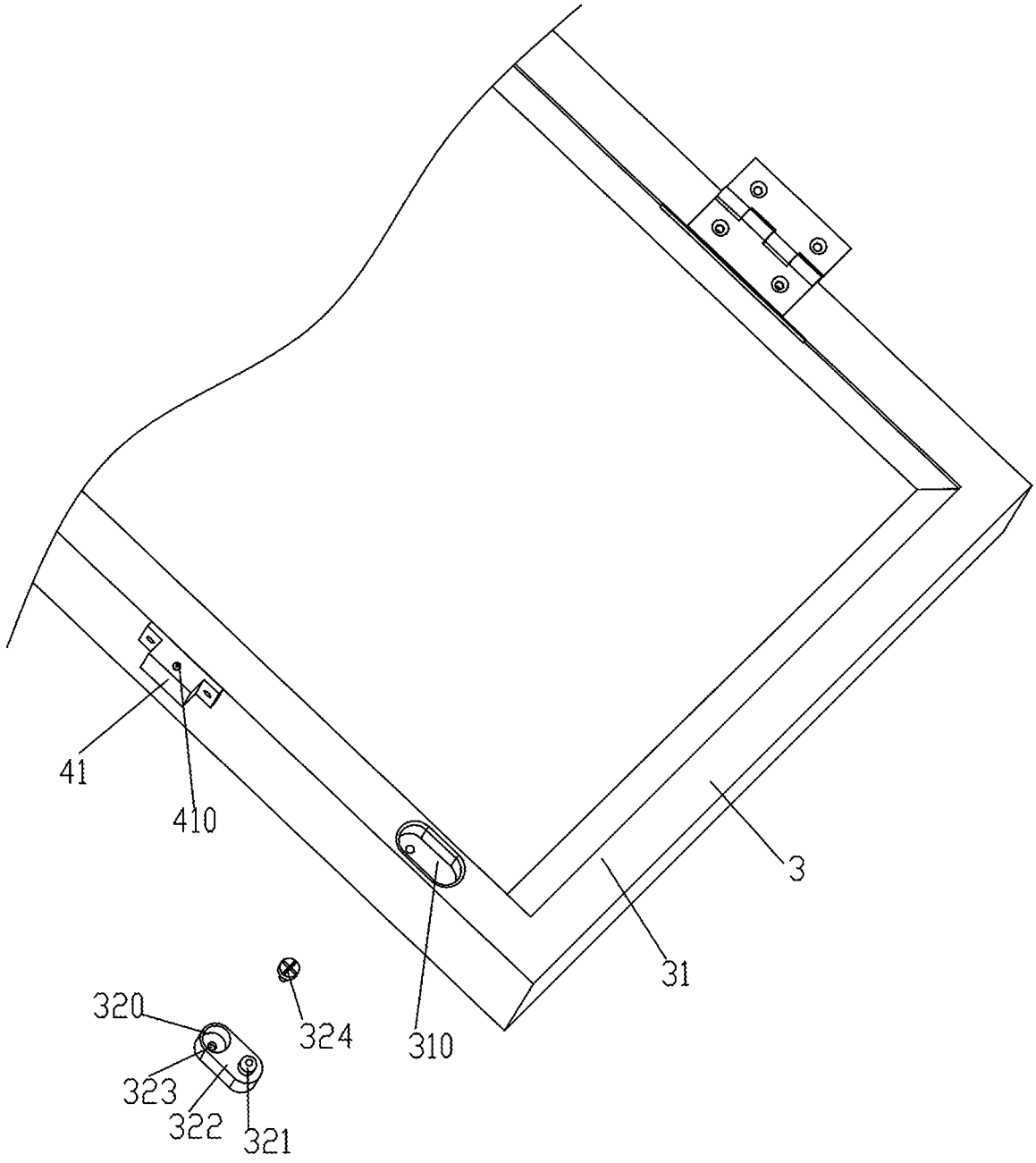
FIG. 4 shows an exploded schematic view of a partial structure of the foldable chessboard box according to the present application.
Figure 5:
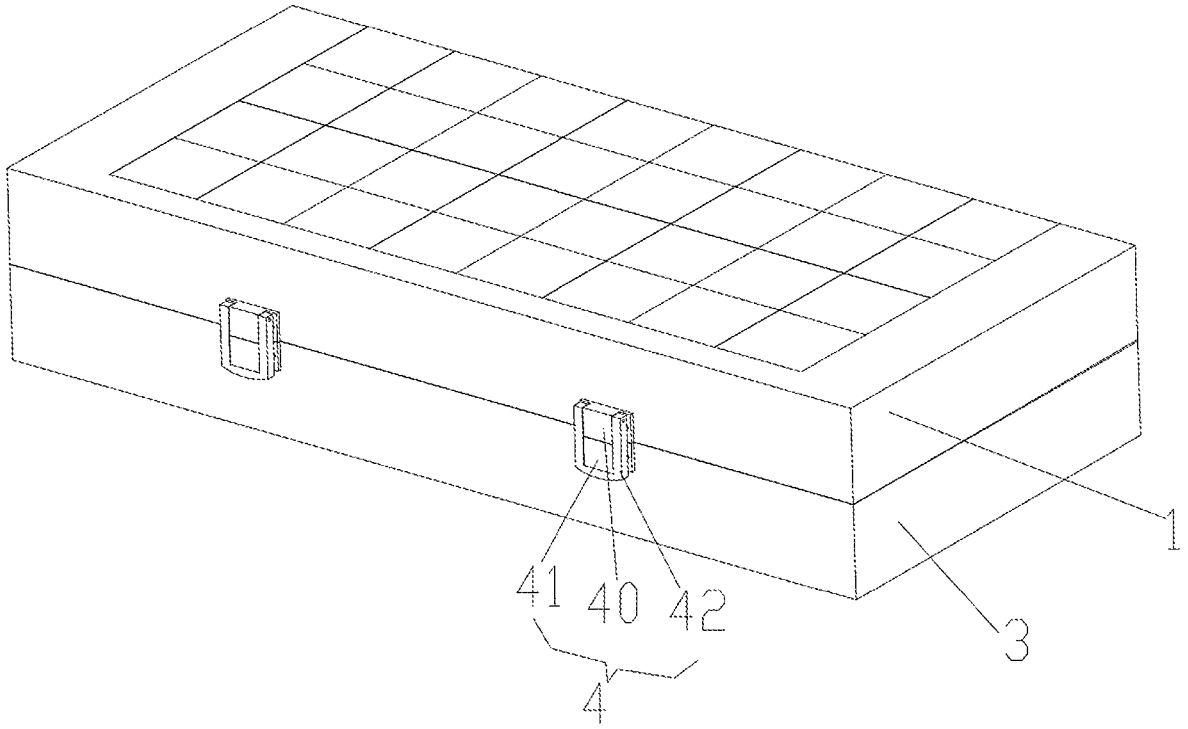
FIG. 5 shows a schematic view of the foldable chessboard box according to the present application in a folded state.

With reference to FIGS. 1 to 5, a foldable chessboard box is provided in the present application, including a first body 1 and a second body 3. The first body 1 and the second body 3 are hinged through a connecting portion 2 so that the first body 1 can be opened or buckled relative to the second body 3. The first body 1 is provided with a first surface 10 and a second surface 11 opposite to the first surface 10. The second body 3 is provided with a third surface 30 and a fourth surface 31 opposite to the third surface 30. The end surface of the connecting portion 2 is higher than the second surface 11 and the fourth surface 31. Both the second surface 11 and the fourth surface 31 are provided with a receiving slot 110 for accommodating chess pieces. Both the first surface 10 and the third surface 30 are provided with a chessboard pattern 100. The second surface 11 is provided with at least one first installation slot 111. The fourth surface 31 is provided with at least one second installation slot 310 relative to the first installation slot 111. Each first installation slot 111 is fixedly provided with a first supporting portion 12. Each second installation slot 310 is fixedly provided with a second supporting portion 32. The first supporting portion 12 includes a first positioning slot 120 and a first supporting foot 121 protruding from the second surface 11. The second supporting portion 32 includes a second positioning slot 320 and a second supporting foot 321 protruding from the fourth surface 31. The end surface of the first supporting foot 121 and the end surface of the second supporting foot 321 are flush and both higher than the connecting portion 2. When the first body 1 is buckled with the second body 3, the first supporting foot 121 is inserted into the second positioning slot 320 and the second supporting foot 321 is inserted into the first positioning slot 120 to make the second surface 11 and the fourth surface 31 fit.

In the present embodiment, the connecting portion 2 is a hinge, and the first body 1 and the second body 3 are hinged through the connecting portion 2, so that the first body 1 can rotate relative to the second body 3, so as to realize the opening or buckling of the foldable chessboard box. When the foldable chessboard box is buckled, it is convenient to carry the foldable chessboard box; and when the foldable chessboard box is fully opened, it can be used as a chessboard.

In the present embodiment, both the second surface 11 and the fourth surface 31 are provided with a receiving slot 110 for accommodating chess pieces. By setting the receiving slot 110, the foldable checkerboard box has the function of storing chess pieces and is convenient to carry.

In the prior art of the foldable checkerboard box, when the first body 1 is fully opened relative to the second body 3 and is used as a checkerboard, the chessboard pattern 100 of the first surface 10 and the chessboard pattern 100 of the third surface 30 are spliced into a chessboard surface. The second surface 11 and the fourth surface 31 are placed against a plane such as the ground for support. Because the end surface of the connecting portion 2 is higher than the second surface 11 and the fourth surface 31, the first surface 10 and the third surface 30 cannot be spliced into a plane, and there is a problem of unstable placement of the chessboard surface. And the chessboard surface will shake when the users are playing chess, which affects the smooth placement of the pieces on the board. To solve this problem, the present invention provides the following technical solutions.

Specifically, the second surface 11 is provided with two first installation slots 111, and correspondingly, the fourth surface 31 is provided with two second installation slots 310. Each of the first installation slots 111 is fixedly provided with a first supporting portion 12, and each of the second installation slots 310 is fixedly provided with a second supporting portion 32. The first supporting portion 12 includes a first positioning slot 120 and a first supporting foot 121 protruding from the second surface 11. The second supporting portion 32 includes a second positioning slot 320 and a second supporting foot 321 protruding from the fourth surface 31. The end surface of the first supporting foot 121 and the end surface of the second supporting foot 321 are flush and both higher than the connecting portion 2. Therefore, when the first body 1 is fully opened relative to the second body 3 and is used as a chessboard, the first supporting foot 121 and the second supporting foot 321 are placed against a plane such as the ground for support. Because of the height difference, the second surface 11, the fourth surface 31 and the connecting portion 2 will not abut against the ground. The end faces of the first supporting foot 121 and the second supporting foot 321 are flush, so that the first surface 10 and the third surface 30 can be spliced into a plane, which solves the problem of unstable placement of the chessboard surface. Thus, when the users are playing chess, the chessboard surface will not shake, avoiding affecting the smooth placement of the pieces on the board. Meanwhile, the first supporting portion 12 installed in the first installation slot 111 and the second supporting portion 32 installed in the second installation slot 310 are staggered. When the first body 1 and the second body 3 are buckled, the first supporting foot 121 is inserted into the second positioning slot 320 and the second supporting foot 321 is inserted into the first positioning slot 120, which prevents the first supporting foot 121 from abutting against the fourth surface 31 and prevents the second support foot 321 from abutting against the second surface 11, so as to realize the fitting of the second surface 11 and the fourth surface 31, and prevent the setting of the first supporting foot 121 and the second supporting foot 321 from affecting the buckling relationship between the first body 1 and the second body 3.

The structural design of the present invention not only solves the problem of unstable placement of the chessboard surface in the prior art, but also avoids affecting the buckle of the first body 1 and the second body 3.

In the present embodiment, the cross-sectional area of the first supporting foot 121 and the second supporting foot 321 are smaller than that of the first positioning slot 120 and the second positioning slot 320, so that when the first body 1 is buckled with the second body 3, it is ensured that the first supporting foot 121 is accurately inserted into the second positioning slot 320, and the second supporting foot 321 is accurately inserted into the first positioning slot 120.

In the present embodiment, the cross-sections of the first supporting foot 121 and the second supporting foot 321 are both circular, and the cross-sectional shapes of the first positioning slot 120 and the second positioning slot 320 are both circular. In other embodiments, they can also be set in other forms.

Further, when the first body 1 is completely opened relative to the second body 3, the first surface 10 and the third surface 30 are flush to make the first surface 10 and the third surface 30 spliced into a plane, and the chessboard pattern 100 of the first face 10 and the chessboard pattern 100 of the third face 30 are spliced into a complete chessboard surface.

Further, the first supporting portion 12 further includes a first fixing portion 122. The first supporting foot 121 is fixedly connected to the first fixing portion 122 and is perpendicular to the end surface of the first fixing portion 122.

In the present embodiment, in order to conveniently control the protruding distance of the first supporting foot 121 relative to the second surface 11, so as to ensure that the end surface of the first supporting foot 121 and the end surface the second supporting foot 321 are flush, the first supporting foot 121 is set perpendicular to the end surface of the first fixing portion 122.

Further, the first positioning slot 120 is arranged on the first fixing portion 122. The first fixing portion 122 is further provided with a first fixing hole 123. A first fixing component 124 penetrates the first fixing hole 123 and is fixedly connected to the first body 1 to fix the first supporting portion 12 in the first installation slot 111.

In the present embodiment, the first fixing hole 123 is arranged on the bottom wall of the first positioning slot 120 to be in connection with the first positioning slot 120. The first fixing component 124 is a screw, and the first fixing component 124 penetrates the first fixing hole 123 and is fixedly connected to the first body 1 to fix the first supporting portion 12 in the first installation slot 111. When the second supporting foot 321 is inserted into the first positioning slot 120, the end surface of the second supporting foot 321 does not abut against the first fixing component 124.

Further, the end surface of the first fixing portion 122 does not protrude relative to the second surface 11, so as to prevent the end surface of the first fixing portion 122 from abutting against the fourth surface 31 when the first body 1 and the second body 3 are buckled.

Further, the second supporting portion 32 further includes a second fixing portion 322. The second supporting foot 321 is fixedly connected to the second fixing portion 322 and is perpendicular to the end surface of the second fixing portion 322.

In the present embodiment, in order to conveniently control of the protruding distance of the second supporting foot 321 relative to the second surface 11, so as to ensure that the end surface of the first supporting foot 121 and the end surface of the second supporting foot 321 are flush, the second supporting foot 321 is set perpendicular to the end surface of the second fixing portion 322.

Further, the second positioning slot 320 is arranged on the second fixing portion 322. The second fixing portion 322 is further provided with a second fixing hole 323. A second fixing component 324 penetrates the second fixing hole 323 and is fixedly connected to the second body 3 to fix the second supporting portion 32 in the second installation slot 310.

In the present embodiment, the second fixing hole 323 is arranged on the bottom wall of the second positioning slot 320 to be in connection with the second positioning slot 320. The second fixing component 324 is a screw, and the second fixing component 324 penetrates the second fixing hole 323 and is fixedly connected to the second body 3 to fix the second supporting portion 32 in the second installation slot 310. When the first supporting foot 121 is inserted into the second positioning slot 320, the end surface of the first supporting foot 121 does not abut against the second fixing component 324.

Further, the end surface of the second fixing portion 322 does not protrude relative to the fourth surface 31, so as to prevent the end surface of the second fixing portion 322 from abutting against the second surface 11 when the first body 1 and the second body 3 are buckled.

Further, the foldable chessboard box also includes at least one locking device 4. The locking device 4 includes a first lock body 40, a second lock body 41 and a locking portion 42. The first lock body 40 is fixedly connected to the first body 1. The second lock body 41 is fixedly connected to the second body 3. The locking portion 42 is movably connected to the first lock body 40, and the locking portion 42 can movably buckle the first lock body 40 and the second lock body 41.

In the present embodiment, the locking portion 42 has a closed cavity. When the first body 1 is buckled with the second body 3, the locking portion 42 is rotated so that the first lock body 40 and the second body 41 are embedded in the closed cavity of the locking portion 42 to achieve the purpose of locking, so that the first body 1 and the second body 3 remain in a buckled state, which is convenient to carry and can prevent the chess pieces in the receiving slot 110 from falling out.

Further, the end surface of the first lock body 40 is not higher than the second surface 11, and the end surface of the second lock body 41 is not higher than the fourth surface 31. The end surface of the first lock body 40 is also provided with a locking slot 400. The end surface of the second lock body 41 is also protrudingly provided with a positioning block 410 higher than the fourth surface 31 but lower than the end surface of the second supporting foot 321. When the first body 1 is buckled with the second body 3, the positioning block 410 is inserted into the locking slot 400 to make the second surface 11 and the fourth surface 31 fit.

In the present embodiment, the matching between the locking slot 400 and the positioning hole are provided to realize the positioning between the first lock body 40 and the second lock body 41. Since the positioning block 410 is higher than the fourth surface 31 but lower than the end surface of the second supporting foot 321, without the first supporting foot 121 and the second supporting foot 321 of the present invention, when the first body 1 is opened relative to the second body 3 for chessboard, it will inevitably further affect the flatness of the chessboard surface. Therefore, through the structural design of the present invention, the problem of the flatness of the chessboard surface can be well solved.

It should be noted that the present application may have other various embodiments. Modifications and variations made by those skilled in the art based on the embodiments according to the present application without any creative work also fall within the scope of the present application.

What is claimed is:

1. A foldable chessboard box, comprising a first body and a second body, wherein the first body and the second body are hinged through a connecting portion so that the first body is capable of being opened or buckled relative to the second body;

wherein the first body is provided with a first surface and a second surface opposite to the first surface, and the second body is provided with a third surface and a fourth surface opposite to the third surface, wherein the end surface of the connecting portion is higher than the second surface and the fourth surface;

wherein both the second surface and the fourth surface are provided with a receiving slot for accommodating chess pieces, and both the first surface and the third surface are provided with a chessboard pattern;

wherein the second surface is provided with at least one first installation slot, and the fourth surface is provided with at least one second installation slot relative to the first installation slot;

wherein each first installation slot is fixedly provided with a first supporting portion comprising a first positioning slot and a first supporting foot protruding from the second surface, and each second installation slot is fixedly provided with a second supporting portion comprising a second positioning slot and a second supporting foot protruding from the fourth surface, wherein the end surface of the first supporting foot and the end surface of the second supporting foot are flush and both higher than the connecting portion; and wherein the first supporting foot is inserted into the second positioning slot and the second supporting foot is inserted into the first positioning slot to make the second surface and the fourth surface fit when the first body is buckled with the second body.

2. The foldable chessboard box according to claim 1, wherein when the first body is fully opened relative to the second body, the first surface and the third surface are flush and the chessboard pattern of the first surface and the chessboard pattern of the third surface are spliced into a complete chessboard surface.

3. The foldable chessboard box according to claim 1, wherein the first supporting portion further comprises a first fixing portion, and the first supporting foot is fixedly connected to the first fixing portion and is perpendicular to the end surface of the first fixing portion.

4. The foldable chessboard box according to claim 3, wherein the first positioning slot is arranged on the first fixing portion, and the first fixing portion is further provided with a first fixing hole, wherein a first fixing component penetrates the first fixing hole and is fixedly connected to the first body to fix the first supporting portion in the first installation slot.

5. The foldable chessboard box according to claim 3, wherein the end surface of the first fixing portion does not protrude relative to the second surface.

6. The foldable chessboard box according to claim 1, wherein the second supporting portion further comprises a second fixing portion, and the second supporting foot is fixedly connected to the second fixing portion and is perpendicular to the end surface of the second fixing portion.

7. The foldable chessboard box according to claim 6, wherein the second positioning slot is arranged on the second fixing portion, and the second fixing portion is further provided with a second fixing hole, wherein a second fixing component penetrates the second fixing hole and is fixedly connected to the second body to fix the second supporting portion in the second installation slot.

8. The foldable chessboard box according to claim 6, wherein the end surface of the second fixing portion does not protrude relative the fourth surface.

9. The foldable chessboard box according to claim 1, wherein the foldable chessboard box further comprises at least one locking device, wherein the locking device comprises:

a first lock body fixedly connected to the first body, a second lock body fixedly connected to the second body, and a locking portion movably connected to the first lock body and capable of movably buckling the first lock body and the second lock body.

10. The foldable chessboard box according to claim 9, wherein the end surface of the first lock body is not higher than the second surface, and the end surface of the second lock body is not higher than the fourth surface, wherein the end surface of the first lock body is further provided with a locking slot, and the end surface of the second lock body is further protrudingly provided with a positioning block higher than the fourth surface but lower than the end surface of the second supporting foot, and wherein the positioning block is inserted into the locking slot to make the second surface and the fourth surface fit when the first body is buckled with the second body.

* * * * *